United States Patent [19]

Hendrickson

[11] Patent Number: 4,856,408

[45] Date of Patent: Aug. 15, 1989

[54] SHOT AND POWDER LOADING SYSTEM

[76] Inventor: Walter R. Hendrickson, 2215 E. Orange Grove, Pasadena, Calif. 91104

[21] Appl. No.: 228,354

[22] Filed: Aug. 4, 1988

[51] Int. Cl.[4] ..... F42B 33/02; B67D 5/06

[52] U.S. Cl. ..... 86/29; 86/31; 86/1.1; 222/185

[58] Field of Search ..... 86/23, 24, 29, 31, 33; 141/250; 222/55, 345, 185

[56] References Cited

U.S. PATENT DOCUMENTS

| | | | |
|---|---|---|---|
| 317,484 | 5/1885 | Baird | 86/31 |
| 506,425 | 10/1893 | Elliott | 86/29 |
| 528,843 | 11/1894 | Allen | 86/29 |
| 561,439 | 6/1896 | Saffold | 86/31 |
| 1,604,145 | 10/1926 | Candee | 86/31 |
| 2,437,216 | 3/1948 | Wilson et al. | 86/31 |
| 2,749,790 | 6/1956 | Miller | 86/31 |
| 3,014,400 | 12/1961 | Smith | 86/33 |
| 3,113,483 | 12/1963 | Puth | 86/23 |
| 4,186,646 | 2/1980 | Martin | 86/29 |
| 4,292,877 | 10/1981 | Lee | 86/31 |
| 4,295,409 | 10/1981 | Simpson | 86/31 |
| 4,629,093 | 12/1986 | Le Molaire | 222/40 |
| 4,733,594 | 3/1988 | Bajohr | 86/31 |

FOREIGN PATENT DOCUMENTS

| | | | |
|---|---|---|---|
| 551506 | 11/1956 | Italy | 86/31 |

*Primary Examiner*—Howard J. Locker

*Attorney, Agent, or Firm*—Christie, Parker & Hale

[57] ABSTRACT

The present invention provides a modification or replacement for shot and powder loading systems having wad jammer tubes with telescopic loading funnels wherein the wad jammer tube is swaged for insertion into smaller shotgun shells creating a shoulder on which shot or powder may jam. The improvement of the invention comprises matching liner tubes having scarfed upper extremities in combination with scarf necked funnels telescopically inserted within the wad jammer tube thereby eliminating all diametric restrictions to prevent shot and powder jamming.

4 Claims, 3 Drawing Sheets

SHOT AND POWDER LOADING SYSTEM

FIELD OF THE INVENTION

This invention relates generally to powder and shot loading systems for reloading shotgun shells. In particular the invention provides a combination of diameter matching liner tubes having scarfed upper extremities and scarf necked funnels to preclude jamming of shot and powder in wad jammer tubes having common diameter upper barrels for loading machine interface and lower wad jammer barrel portions swaged to match shell gauge.

BACKGROUND OF THE INVENTION

Shotgun shell reloading systems are typically designed with interchangeable wad jammer tubes for loading various gauges of shotgun shells. The wad jammer tube comprises an upper barrel portion received within the loading machine and a lower barrel portion received within the shotgun shell which comprises the wad jammer. The upper barrel portion is of a common diameter for all gauges to allow common interface with the loading machine. Typically the lower barrel portion is formed to match the gauge of the shotgun shell by swaging the wad jammer tube in one or more steps to the appropriate gauge diameter. Swaging of the tube causes a shoulder on the internal diameter of the tube.

Loading funnels comprising a first funnel portion and second body portion sized to be closely received telescopically within the upper barrel portion of the jammer tube are a second component of the loading system. When loading a shotgun shell, shot flows through the funnel and into the body portion, over the shoulder of the swage in the jammer tube, through the lower barrel of the jammer tube and into the shotgun shell. Often the shot will aggregate and jam within the shoulder portion of the jammer tube. This results in an insufficient shot load being placed in the shotgun shell and requires disassembly of the loading funnel and jammer tube from the loading machine to clear the jam.

This problem is particularly severe for jammer tubes swaged for 0.410 shotgun shells. The loading machine accommodates jammer tubes for 12 gauge shells, thereby establishing the diameter standard for the upper barrel portion of the jammer tubes. The diameter difference in the 12 gauge and 0.410 shell causes a significant shoulder to be formed when swaging the lower barrel portion of the 0.410 jammer tubes.

A system which may be retrofitted to existing wad jammer tube and funnel systems or a replacement for the funnel tube and wad jammer tube system which is compatible with existing loading machines to prevent shot and powder aggregation and jamming at the shoulder is highly desirable.

SUMMARY OF THE INVENTION

The present invention provides a jam preventing modification for existing funnel and wad jammer tube systems, a replacement funnel compatible with current wad jammer tubes, and a complete replacement system of loading funnel and wad jammer tube. The invention is used in a shot and powder loading system with a wad jammer tube having an upper barrel portion, a swaged tapering shoulder, and a lower barrel portion and a loading funnel having a cylindrical body portion telescopically received within the upper barrel portion of the wad jammer. A liner tube is provided having an internal diameter no greater than the internal diameter of the lower barrel portion of the wad jammer. The liner tube is closely received within the body portion of the loading funnel. The upper end of the liner tube is scarfed at an angle such that the apex of the scarf is at least one shot pellet diameter higher than the base of the scarf. Further, the tube wall of the liner tube is tapered in the scarf on the internal wall to a knife edge at the scarf lip.

As an alternative, the invention provides as a second embodiment a replacement funnel wherein the inner diameter of the cylindrical body portion of the funnel is no greater than the inner diameter of the lower barrel portion of the wad jammer. Further, the body portion of the funnel extends beyond any shoulder portion of the jammer tube in the loading position.

DETAILED DESCRIPTION OF THE INVENTION

Figure 1A:
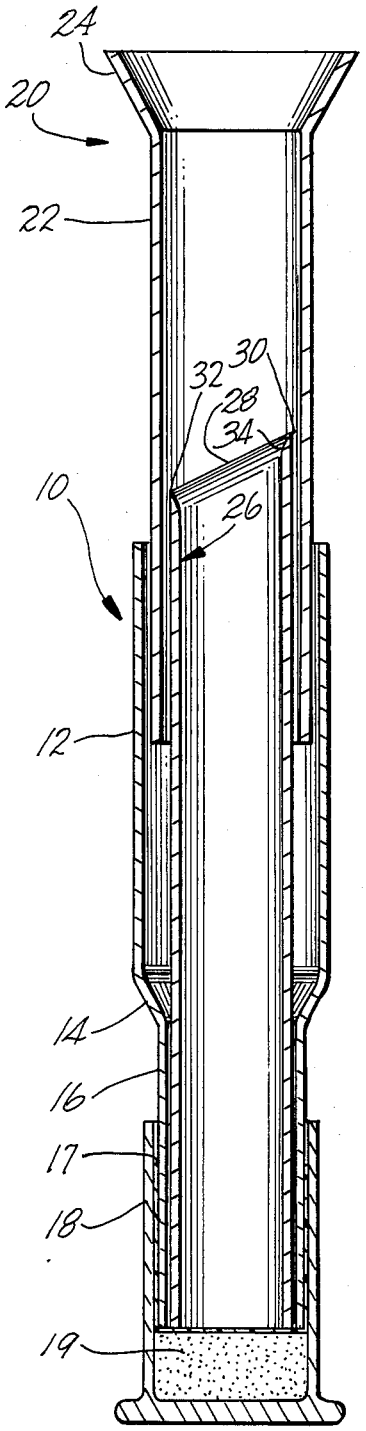
FIG. 1*a* is a sectional side view of the first embodiment of the invention having a full length liner tube.

A first embodiment of the invention provides a system for retrofitting existing shot and powder loading systems. Referring to FIG. 1*a*, existing systems provide a wad jammer tube 10 having an upper barrel portion 12, a swaged tapering shoulder 14, and a lower barrel portion 16. The lower barrel portion of the wad jammer tube is sized to be received by a wad 17 for insertion into shotgun shell 18, for constraining powder 19 in the shell. A loading funnel 20 having a cylindrical body portion 22 is telescopically received within the upper barrel portion of the wad jammer tube.

Figure 1B:
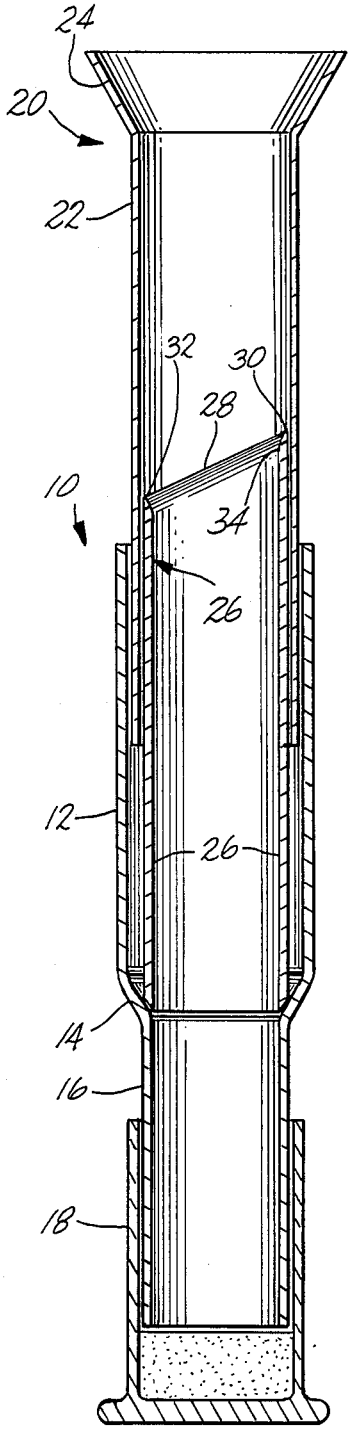
FIG. 1*b* is a section view of the shoulder portion of the jammer tube with a partial length liner tube.

Shot loaded through the funnel 24 runs through the cylindrical body portion into the wad jammer tube. During the loading process the loading funnel is engaged by the loading machine in a stationary position. The wad jammer tube is extended down into the shotgun shell from the cylindrical body of the loading funnel telescopically. Shot falling through the cylindrical body portion often becomes lodged at the shoulder and jams preventing proper shot loading in the shotgun shell. The present invention provides a liner tube 26 which is closely received within the cylindrical body portion of the loading funnel. The inner diameter of the liner tube is less than the inner diameter of the lower barrel portion of the wad jammer tube. The liner tube may extend into the lower barrel portion of the wad jammer tube as shown in FIG. 1*a* or the interface may be as shown in FIG. 1*b* where the lower edge of the liner tube is tapered to rest against the shoulder such that shot falling through the liner tube will not impinge the shoulder, thereby preventing jamming.

Additionally, referring again to FIG. 1*a*, the liner tube has a scarfed upper end 28 with the apex of the scarf 30 higher than the base 32 of the scarf by at least the diameter of one shot pellet of the largest shot to be used. The internal wall 34 in the scarf is tapered to a knife edge at the scarf lip. The angle of the scarf and the tapered inner wall prevent jamming of shot at the upper edge of the liner tube.

With the presence of the liner tube, no jamming of shot takes place and a full shot load is assured in the shotgun shell.

Figure 2:
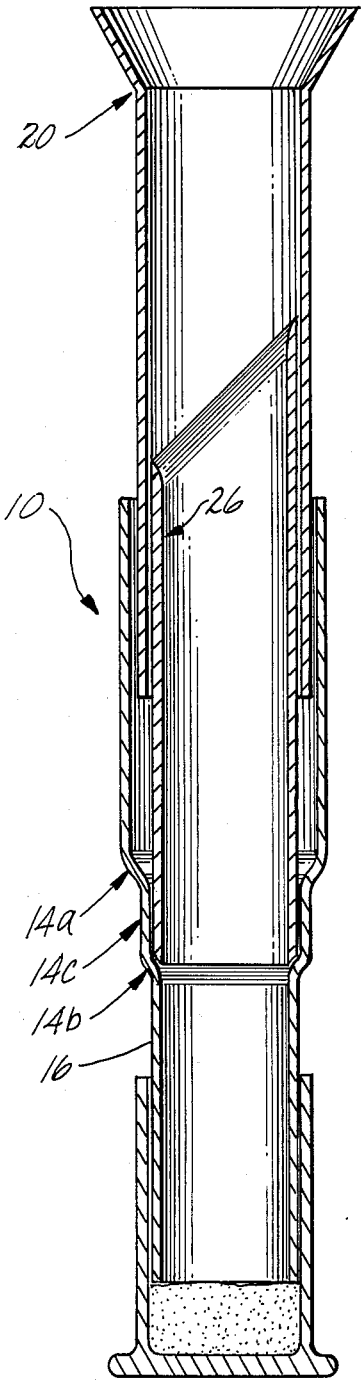
FIG. 2 is a side section view of the invention in a jammer tube having a double swage.

For smaller gauge shotgun shells, the wad jammer tube is often swaged in two steps as shown in FIG. 2. The first swage causes a first shoulder 14*a* while the second swage causes a second shoulder 14*b*. The inner diameter of the liner tube is no greater than the inner diameter of the lower barrel portion and the outer diameter of the liner tube may be accommodated within the swage neck 14*c*. In some applications fabrication of the wad jammer tube may be accomplished using an internal diameter mandrel resulting in the second swage affecting only the outer diameter of the wad jammer tube. In this type of installation the configurations of the invention shown in FIGS. 1*a* and 1*b* are applicable. Swaging or machining techniques well known in the art may be used to form the liner tube for a constant inner diameter with outer diameters matching to be closely received within the swage neck 14*c* and the cylindrical body portion of the loading funnel. In the alternative, multiple matched outer diameter and inner diameter tubes may be telescopically nested and used to form the liner tube thereby matching the outer diameter of the liner to both the inner diameter of the cylindrical body portion and the inner diameter of the lower barrel portion.

Figure 4:
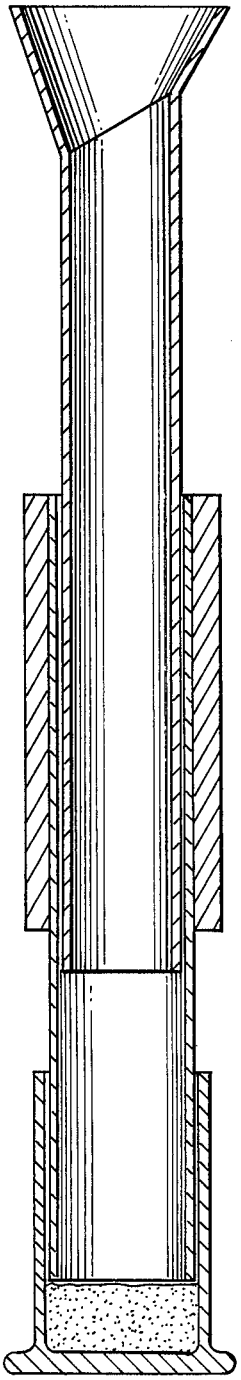
FIG. 4 is a side sectional view of a configuration of the invention for replacement of existing loading funnel and wad jammer tubes.
Figure 3:
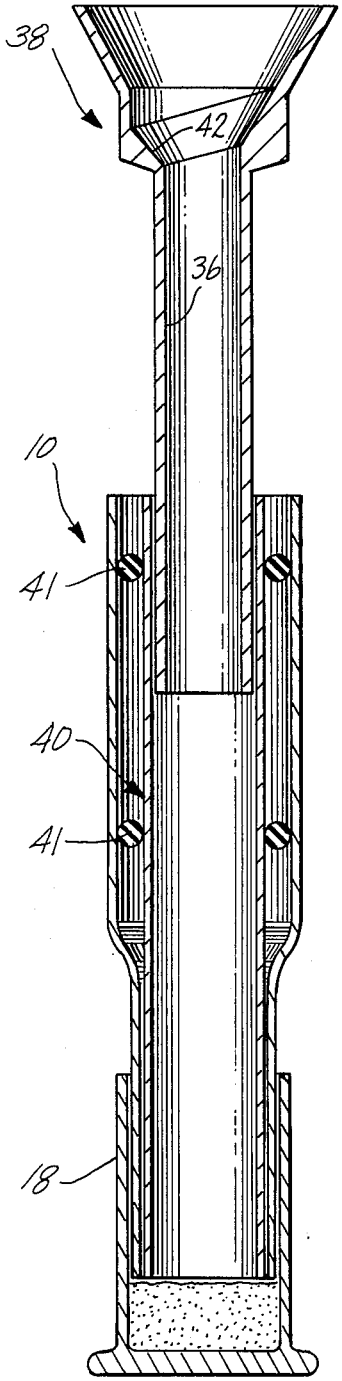
FIG. 3 is a side sectional view of a second embodiment of the invention having both a liner tube and a reduced diameter funnel body.

A second embodiment of the invention is shown in FIGS. 3 and 4. Avoiding impingement of shot or powder on a shoulder is accomplished in the invention by nesting the telescopic interrelationship of parts of the loading system in increasing diameters such that the shot traveling through the system is never exposed to a diametric constriction. As shown in FIG. 3, this may be accomplished by providing a reduced diameter cylindrical body portion 36 on a modified loading funnel 38. The reduced diameter body portion is telescopically received within the liner sleeve 40 which is of substantially equal length to the wad jammer tube. The liner is held in place by O-rings 41 or other suitable means. The shoulder portion 42 of the modified loading funnel is tapered eccentrically to preclude jamming of the shot prior to entry into the reduced diameter cylindrical body portion. The angle of the eccentric taper provides at least one shot pellet diameter difference between high and low points to prevent jamming similar to the scarf in the liner tube of the first embodiment. Shot loading through the modified loading funnel will not impinge any diametrical constriction in the wad jammer tube due to the increasing diametrical relationship of the reduced diameter cylindrical body portion liner tube and wad jammer. Obtaining full shot loading of the shotgun shell is thereby assured.

Powder loading using the second embodiment of the invention is enhanced by the elimination of any entrapment areas for powder.

FIG. 4 provides an alternative arrangement of wad jammer tube and loading funnel for replacement of existing systems. The wad jammer tube 44 comprises a first upper body portion 46 having an outer diameter sized to be received by the loading machine as a replacement for current wad jammer tubes. The lower body portion 48 may be formed by machining the outer diameter to match the shotgun shell gauge or by fabricating the jammer tube from two or more tube sections of varying interengaging inner and outer diameters. The lower body portion of the jammer tube must have a smooth surface, parallel walls, or, in the ideal case, lower walls slightly diverging from top to bottom to further insure no jamming of shot or powder in the lower body portion when the jammer tube is withdrawn from the shotgun shell.

The loading funnel 50 comprises a cylindrical body portion received telescopically within the wad jammer tube and a funnel portion 62 formed by a non-symmetrical frustoconical section connecting to the body portion eccentrically at an angle such that the upper extremity of the cylindrical body portion attachment to the funnel is at least one shot pellet diameter higher than the lowest connection point between the cylindrical body and the funnel to preclude jamming as previously described. Shot and powder passing through the loading funnel again impinges on no diametrical constrictions, thereby preventing jamming and assuring consistent loading of the shotgun shells.

Having described the invention in detail as required by the Patent statutes, those skilled in this art will have no difficulty in fabricating and arranging the elements of the invention to meet specific needs. Such modifications are within the scope and intent of the present invention as defined in the following claims.

What is claimed is:

1. An improvement for a shot and powder loading system having a wad jammer tube with an upper barrel portion, a swaged tapering shoulder, and a lower barrel portion and a loading funnel having a cylindrical body portion telescopically received within the upper barrel portion of the wad jammer tube, the improvement comprising a liner tube closely received within the body portion of the loading funnel and interfacing with the lower barrel portion of the wad jammer tube, the interface adapted to avoid shot and powder contact with the swaged tapering shoulder of the wad jammer tube, the liner tube further having a scarfed upper end with the apex of the scarf at least one shot pellet diameter higher than the base of the scarf and the tube wall in the scarf tapered on the internal wall to a knife edge at the scarf lip.

2. An improvement to a shot and powder loading system as described in claim 1 wherein the interface of the liner tube with the lower barrel portion of the wad jammer tube comprises an extension of the liner tube substantially through the lower barrel portion of the wad jammer tube.

3. An improvement to a shot and powder loading system as defined in claim 1 wherein the interface between the liner tube and the lower barrel portion of the wad jammer tube comprises a lower edge of the liner tube tapered from the outer diameter to engage the shoulder of the wad jammer tube thereby substantially aligning the inner diameter of the liner tube with the inner diameter of the lower barrel portion of the wad jammer tube.

4. A shot and powder loading system comprising:

a wad jammer tube having a lower barrel portion; and, a loading funnel having a cylindrical body portion with an outer diameter closely receivable within the lower barrel portion of the wad jammer tube, the cylindrical body portion having an upper end angularly terminated with an apex at least one shot pellet diameter higher than the nadir, and a non-orthogonal frustoconical portion open at an upper larger diameter termination and having a lower smaller diameter termination at a complementary angle to the upper end of the cylindrical body portion and connected thereto.

* * * * *